US005467604A

United States Patent [19]

Sekigami et al.

[11] Patent Number: 5,467,604

[45] Date of Patent: Nov. 21, 1995

[54] MULTIROOM AIR CONDITIONER AND DRIVING METHOD THEREFOR

[75] Inventors: Kunie Sekigami, Oota; Kouji Nagae; Makoto Shimotani, both of Ooizumimachi, all of Japan

[73] Assignee: Sanyo Electric Co., Ltd., Oosaka, Japan

[21] Appl. No.: 388,565

[22] Filed: Feb. 14, 1995

[30] Foreign Application Priority Data

Feb. 18, 1994 [JP] Japan ..... 6-045171

[51] Int. Cl.[6] ..... F25B 7/00

[52] U.S. Cl. ..... 62/117; 62/175

[58] Field of Search ..... 165/22; 62/160, 62/175, 324, 6, 117

[56] References Cited

U.S. PATENT DOCUMENTS 4,878,357 11/1989 Sekigami et al. ..... 62/160

5,361,595 11/1994 Shimura et al. ..... 62/175

*Primary Examiner*—William E. Wayner

*Attorney, Agent, or Firm*—Darby & Darby

[57] ABSTRACT

In a multiroom air conditioner and a method of driving a multiroom air conditioner containing plural outdoor side units each containing a compressor, an outdoor fan, an outdoor heat exchanger and a refrigerant path change-over valve, plural indoor side units each containing an indoor heat exchanger, and an inter-unit pipe comprising a high-pressure gas pipe, a low-pressure gas pipe and a liquid pipe through which the plural outdoor side units are connected to the indoor side units to thereby form a refrigerant cycle, and in which each individual indoor side unit independently and selectively performs a room cooling operation or a room heating operation for an individual room, when a stop signal is output to some outdoor side unit in accordance with an indoor load during a room cooling or heating operation, the refrigerant path change-over valve of the outdoor unit is switched and the outdoor fan thereof is driven so that the driving of the compressor of the outdoor side unit is stopped, but refrigerant is allowed to flow into the outdoor heat exchanger of the outdoor side unit.

8 Claims, 2 Drawing Sheets

MULTIROOM AIR CONDITIONER AND DRIVING METHOD THEREFOR

BACKGROUND OF THE INVENTION

1. Field of the Invention

This invention relates to a multiroom air conditioner comprising plural outdoor side units each of which contains a compressor, an outdoor heat exchanger, etc., plural indoor side units each of which contains an indoor heat exchanger and an inter-unit pipe for connecting the plural outdoor side units and the plural indoor side units, which is capable of simultaneously cooling or heating all plural rooms, or simultaneously cooling some rooms and heating the other rooms through an individual control operation for each individual room.

2. Description of Related Art

There has been known a multiroom air conditioner in which plural outdoor side units each containing a compressor, an outdoor heat exchanger, etc. are connected to plural indoor side units each containing an indoor heat exchanger through an inter-unit pipe each comprising a high-pressure gas pipe, a low-pressure gas pipe and a liquid pipe to simultaneously cooling or heating rooms (as disclosed in U.S. Pat. No. 4,878,357).

In this type of multiroom air conditioner, the number of outdoor side units to be operated is adjusted in accordance with an indoor load. On the other hand, in a conventional air-conditional operation mode, when a stop signal is output from a controller to some outdoor side unit, a compressor, an outdoor heat exchanger, an outdoor fan and a refrigerant path change-over valve which are built in the outdoor side unit are simultaneously stopped every outdoor side unit. If this operation mode is applied to the multiroom air conditioner, it is not necessarily preferable for the multiroom air conditioner that all the equipments in the outdoor side unit are simultaneously stopped, and in some cases it is more preferable to control each of the equipments individually rather than the simultaneous control (stopping) operation.

Specifically, it has been hitherto adopted that the driving of a compressor and the operation of an outdoor heat exchanger are controlled simultaneously with each other. Therefore, it has been hitherto impossible to satisfy such a requirement that only the power (capacity) of the outdoor heat exchanger is increased during a driving time of the multiroom air conditioner to heighten the driving efficiency (output/input) of the air conditioner itself, and such a control device for meeting this requirement has not been proposed.

SUMMARY OF THE INVENTION

An object of the present invention is to provide a multiroom air conditioner which is capable of individually controlling each of equipments built in plural outdoor side units.

In order to attain the above object, according to a first aspect of the present invention, a multiroom air conditioner in which each individual indoor side unit independently and selectively performs a room cooling operation or a room heating operation for an individual room, comprises plural outdoor side units each containing a compressor, an outdoor fan, an outdoor heat exchanger and a refrigerant path change-over valve, plural indoor side units each containing an indoor heat exchanger, an inter-unit pipe comprising a high-pressure gas pipe, a low-pressure gas pipe and a liquid pipe through which the plural outdoor side units are connected to the indoor side units to thereby form a refrigerant cycle, and a controller for individually controlling each of the compressor, the outdoor fan, the outdoor heat exchanger and the refrigerant path change-over valve.

In the multiroom air conditioner as described above, when the controller is supplied with a signal for stopping some outdoor side unit in accordance with an indoor load during a room cooling or heating operation, the controller switches the refrigerant path change-over valve of the outdoor unit and drives the outdoor fan thereof so that the driving of the compressor of the outdoor side unit is stopped, but refrigerant is allowed to flow into the outdoor heat exchanger of the outdoor side unit.

In the multiroom air conditioner as described above, the controller outputs a signal for successively controlling the driving of the compressors of the respective outdoor side units in accordance with the indoor load, and the outdoor heat exchanger and the refrigerant path change-over valve of each outdoor side unit are controlled in accordance with a status of the refrigerant cycle.

In the multiroom air conditioner as described above, a gas-lack defection sensor for detecting lack of the refrigerant is provided in the refrigerant cycle. When the gas lack is detected by the gas-lack detection sensor, the controller reduces a heat exchange power of an outdoor side unit for which the stop signal is output. In this case, if the gas-lack state is not repaired by reducing the heat exchange power, the controller stops the driving of the outdoor side unit completely.

In the multiroom air conditioner as described above, the controller continues the driving of the compressor of some outdoor side unit when the room cooling and heating operations are performed simultaneously with each other. If a cooling load and a heating load are substantially equal to each other, the controller switches the refrigerant path change-over valve of the outdoor side unit and stops the driving of the outdoor fan thereof so hat no refrigerant flows into the outdoor heat exchanger of the outdoor side unit.

According to a second aspect of the present invention, a method of driving a multiroom air conditioner which comprises plural outdoor side units each containing a compressor, an outdoor fan, an outdoor heat exchanger and a refrigerant path change-over valve, plural indoor side units each containing an indoor heat exchanger, and an inter-unit pipe comprising a high-pressure gas pipe, a low-pressure gas pipe and a liquid pipe through which the plural outdoor side units are connected to the indoor side units to thereby form a refrigerant cycle, and in which each individual indoor side unit independently and selectively performs a room cooling operation or a room heating operation for an individual room, is characterized in that when a stop signal is output to some outdoor side unit in accordance with an indoor load during a room cooling or heating operation, the refrigerant path change-over valve of the outdoor unit is switched and the outdoor fan thereof is driven so that the driving of the compressor of the outdoor side unit is stopped, but refrigerant is allowed to flow into the outdoor heat exchanger of the outdoor side unit.

In the driving method for the air conditioner as described above, a gas-lack defection sensor for detecting lack of refrigerant of the indoor side unit under operation is provided in the refrigerant cycle. In the outdoor side unit which is supplied with the stop signal on the basis of a signal from the gas-lack detection sensor, the driving of the compressor of the outdoor side unit is stopped, and the heat exchange power of the outdoor heat exchanger of the outdoor side unit is reduced. In this case, if the gas-lack state is not repaired by reducing the heat exchange power, the driving of the outdoor side unit is completely stopped.

According to a third aspect: of the present invention, a method of driving a multiroom air conditioner which comprises plural outdoor side units each containing a compressor, an outdoor fan, an outdoor heat exchanger and a refrigerant path change-over valve, plural indoor side units each containing an indoor heat exchanger, and an inter-unit pipe comprising a high-pressure gas pipe, a low-pressure gas pipe and a liquid pipe through which the plural outdoor side units are connected to the indoor side units to thereby form a refrigerant cycle, and in which each individual indoor side unit independently and selectively performs a room cooling operation or a room heating operation for an individual room, is characterized in that the compressor of some outdoor side unit is driven in a cooling and heating mixing operation in which an indoor side unit performs a cooling operation and another outdoor side unit performs a heating operation. During this operation, the refrigerant path change-over valve of the outdoor side unit is switched and the driving of the outdoor fan thereof is stopped so that no refrigerant flows into the outdoor heat exchanger of the outdoor side unit.

In a case where all the rooms are simultaneously cooled, the change-over valves of the respective outdoor heat exchanger and the change-over valves of the respective indoor heat exchanger are set to a cooling state, so that high-pressure gas refrigerant discharged from each compressor flows from a discharge pipe through a high-pressure gas pipe into the respective outdoor heat exchanger in parallel. The high-pressure gas refrigerant is then condensed and liquefied in each outdoor heat exchanger. The liquefied high-pressure gas refrigerant is passed through an auxiliary refrigerant pressure reducer whose valve opening degree is set to a substantially fully-opened value and a liquid pipe in this order, and then distributed to a refrigerant pressure reducer of each indoor side unit to be changed to low-pressure liquid refrigerant under reduced pressure. Thereafter, the low-pressure liquid refrigerant is vaporized in each indoor heat exchanger, then passed through a low-pressure gas pipe and a suction pipe of the compressor into the compressors. The vaporization of the refrigerant in each indoor heat exchanger is used to cool each room. Through this cooling operation, all the rooms are simultaneously cooled by the respective indoor heat exchanger each serving as a vaporizer.

On the other hand, in a case where all the rooms are simultaneously heated, the switching values of the respective outdoor heat exchanger and the change-over valves of the respective indoor heat exchanger are set to a heating state, so that the high-pressure gas refrigerant discharged from each compressor flows from the discharge pipe through the high-pressure gas pipe and is distributed to the indoor heat exchanger of the respective indoor side units. The high-pressure gas refrigerant is then condensed and liquefied in each indoor heat exchanger. The condensation and liquefaction of the refrigerant in each indoor heat exchanger is used to heat each room. The liquefied high-pressure gas refrigerant is passed through the refrigerant pressure reducer of each indoor unit (whose valve opening degree is set to a substantially fully opened state) and then joins at the liquid pipe. Thereafter, the joining liquefied high-pressure gas refrigerant is reduced in the auxiliary pressure reducer of each outdoor side unit, then supplied to the respective outdoor heat exchanger to be vaporized, and then flows through the refrigerant suction pipe into the compressors. Through this heating operation, all the rooms are simultaneously heated by the respective indoor heat exchanger each serving as a condenser.

Furthermore, in a case where the cooling operation is carried out for some two rooms simultaneously with the heating operation for a room, the change-over valve of the outdoor heat exchanger of one outdoor side unit is set to the cooling state while the switching value of the outdoor heat exchanger of the other outdoor side unit is closed. In addition, the change-over valves of the indoor heat exchanger of the indoor side units for the cooling operation are set to the cooling state while the switching value of the indoor heat exchanger of the indoor side unit for the heating operation is set to the heating state. With this operation, a part of the refrigerant which is discharged from the compressor of each outdoor side unit flows into only the outdoor heat exchanger of the one outdoor unit while the remaining refrigerant flows through the high-pressure gas pipe into the indoor heat exchanger of the indoor unit for the heating operation, and condensed and liquefied by the indoor heat exchanger and the outdoor heat exchanger. The refrigerant which has been condensed and liquefied by these heat exchanger is passed through the liquid pipe, distributed to the refrigerant pressure reducer of each indoor unit and then vaporized in each indoor heat exchanger. Thereafter, the refrigerant is passed through the low-pressure gas pipe and the refrigerant suction pipe in this order, and flows into the compressor. As described above, the one room is heated by the indoor heat exchanger serving as the condenser, and the two rooms are cooled by the other indoor heat exchanger serving as the evaporator.

When the indoor load is reduced during the cooling or heating operation, a stop signal for stopping of the driving is output to some outdoor unit. In this case, even when the driving of the compressor of an outdoor side unit which should be stopped is ceased, the refrigerant is allowed to flow into the outdoor heat exchanger of the outdoor side unit. Accordingly, the outdoor heat exchanger to be stopped is effectively used, so that the efficiency of the system can be increased.

Furthermore, at the cooling and heating operation in which an indoor unit performs the cooling operation and another indoor unit performs the heating operation, the power of the outdoor heat exchanger may be reduced to a small one. Therefore, the driving of some outdoor heat exchanger is stopped although the driving of the compressor of the outdoor side unit is continued. In this case, the efficiency of the system can be improved by preventing the refrigerant from flowing into the outdoor heat exchanger.

However, when refrigerant lack occurs in the refrigerant cycle at the cooling or heating operation, the heat exchange power of the outdoor unit to be stopped is reduced. If the refrigerant lack is not still repaired, it is preferable that the driving of the outdoor side unit is perfectly stopped. Therefore, a function of perfectly stopping-the driving of the outdoor side unit is provided to the system.

DETAILED DESCRIPTION OF THE PREFERRED EMBODIMENT

A preferred embodiment according to the present invention will be described hereunder with reference to the accompanying drawings.

Figure 1:
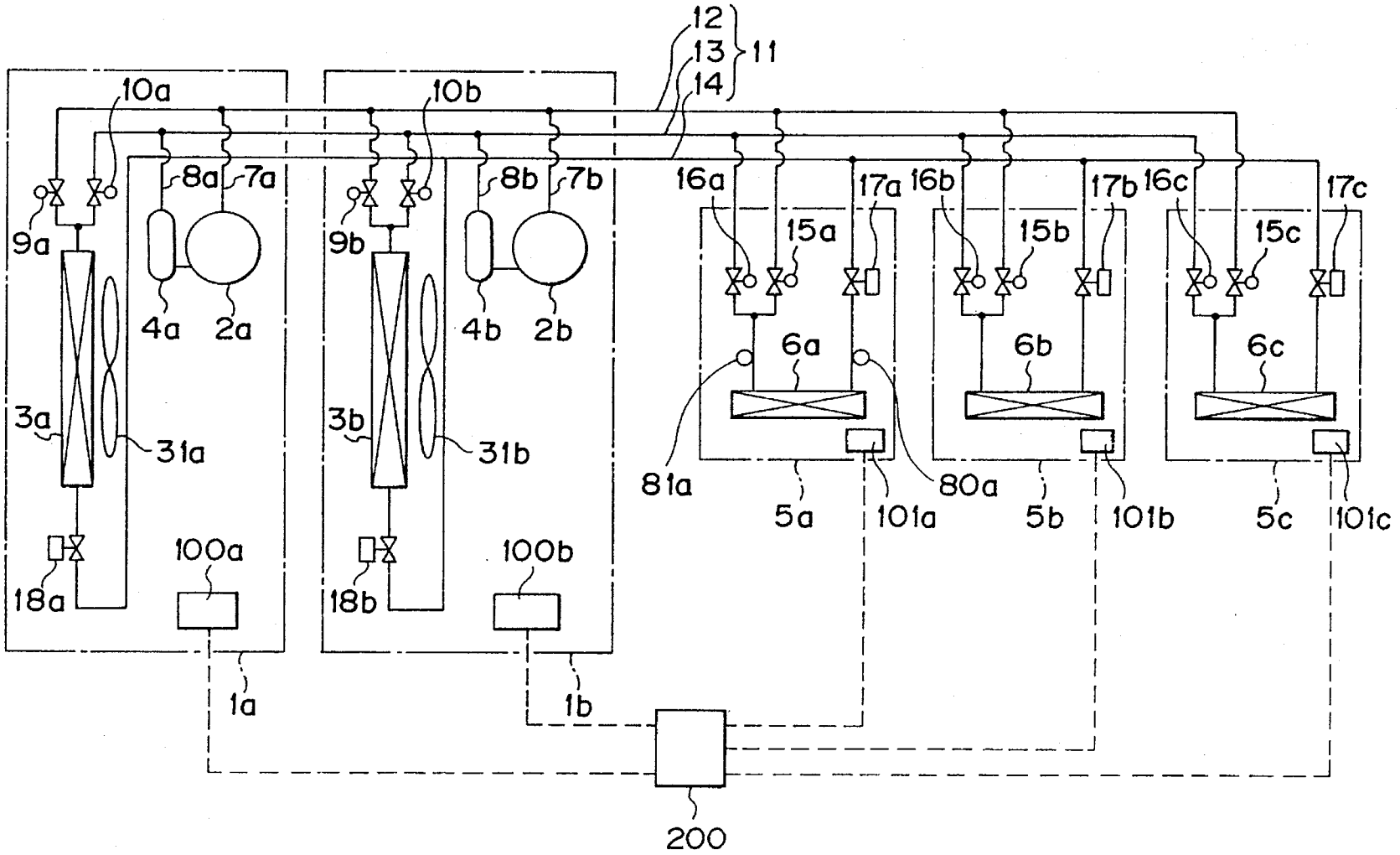
FIG. 1 is a refrigerant circuit diagram for a multiroom air conditioner of an embodiment of the present invention.

FIG. 1 is a refrigerant circuit diagram for a multiroom air conditioner of the present invention. In FIG. 1, reference numerals 1*a* and 1*b* represent outdoor side units. Each outdoor side unit 1*a* (1*b*) is provided with a compressor 2*a* (2*b*), an outdoor heat exchanger 3*a* (3*b*), an outdoor fan 31*a* (31*b*) and a accumulator 4*a* (4*b*). Reference numerals 5*a*, 5*b* and 5*c* represent indoor units, and each indoor unit 5*a* (5*b*, 5*c*) is provided with an indoor heat exchanger 6*a* (6*b*, 6*c*). The outdoor side units 1*a* and 1*b* are connected to the indoor side units 5*a*, 5*b* and 5*c* through an inter-unit pipe 11.

The inter-unit pipe 11 comprises a high-pressure gas pipe 12, a low-pressure gas pipe 13 and a liquid pipe 14, and the respective indoor side units 5*a*, 5*b* and 5*c*, the respective outdoor side units 1*a* and 1*b* and the inter-unit pipe 11 constitute a refrigerant cycle. The high-pressure gas pipe 12 is connected to the compressors 2*a* and 2*b* through refrigerant discharge pipes 7*a* and 7*b* respectively, connected to the outdoor heat exchanger 3*a* and 3*b* through change-over valves 9*a* and 9*b* respectively, and further connected to the indoor heat exchanger 6*a*, 6*b* and 6*c* through change-over valves 15*a*, 15*b* and 15*c* respectively as shown in FIG. 1.

The low-pressure gas pipe 13 is connected to the accumulator 4*a* and 4*b* through refrigerant suction pipes 8*a* and 8*b* respectively, connected to the outdoor heat exchanger 3*a* and 3*b* through change-over valves 10*a* and 10*b*, and further connected to the indoor heat exchanger 6*a*, 6*b* and 6*c* through change-over valves 16*a*, 16*b* and 16*c*. The liquid pipe 14 is connected to the outdoor heat exchanger 3*a* and 3*b* through auxiliary refrigerant pressure reducers 18*a* and 18*b* such as electric expansion valves or the like, and connected to the indoor heat exchanger 6*a*, 6*b* and 6*c* through refrigerant pressure reducers 17*a*, 17*b* and 17*c* of electric expansion valves or the like.

The valve opening degree of the auxiliary refrigerant pressure reducers 18*a* and 18*b* are adjusted when each of the outdoor heat exchanger 3*a* and 3*b* acts as a evaporator, and are set to a substantially full open value when each of the outdoor heat exchanger 3*a* and 3*b* acts as a condenser.

On the other hand, the valve opening degree of the refrigerant pressure reducers 17*a*, 17*b* and 17*c* are set to a substantially full open value when each of the indoor heat exchanger 6*a*, 6*b* and 6*c* acts as a vaporizer, and it is adjusted when each of the indoor heat exchanger acts as a condenser.

Each outdoor side unit 1*a* (1*b*) is provided with a controller (hereinafter referred to as "outdoor controller") 100*a* (100*b*) for controlling the compressor 2*a* (2*b*), the outdoor heat exchanger 3*a* (3*b*), the change-over valves 9*a* and 10*a* (9*b*, 10*b*), the auxiliary refrigerant pressure reducer 18*a* (18*b*), the outdoor fan 31*a* (31*b*), etc. which are built in the outdoor side unit 1*a* (1*b*).

On the other hand, each indoor side unit 5*a* (5*b*, 5*c*) is provided with a controller (hereinafter referred to as "indoor controller") 101*a* (101*b*, 101*c*) for controlling the indoor heat exchanger 6*a* (6*b*, 6*c*), the change-over valves 15*a* and 16*a* (15*b* and 16*b*, 15*c* and 16*c*) and the refrigerant pressure reducer 17*a* (17*b*, 17*c*). Each indoor controller 101*a* (101*b*, 101*c*) is designed to receive a signal from a sensor (not shown) for detecting an air conditioning load in a room and output the signal to a general controller 200. These outdoor and indoor controllers 100*a*, 100*b*, 101*a*, 101*b* and 101*c* are connected to the general controller 200 for collectively control these controllers.

The general controller 200 receives a demand load signal (air conditioning load signal) transmitted from each of the indoor controllers 101*a*, 101*b* and 101*c* and outputs a driving control signal to the outdoor controllers 100*a* and 100*b* in accordance with the received signal.

When supplied with the demand load signal from the indoor controllers 101*a*, 101*b* and 101*c*, the general controller 200 controls the outdoor controllers 100*a* and 100*b* to drive the compressors 2*a* and 2*b*, the outdoor fans 31*a* and 31*b* and the respective change-over valves of the refrigerant path simultaneously or individually.

Next, a driving operation of the multiroom air conditioner as described above will be described.

When all the rooms are cooled at the same time, the change-over valves 9*a* and 9*b* of the outdoor heat exchanger 3*a* and 3*b* are opened while the other change-over valves 10*a* and 10*b* are closed. In addition, the change-over valves 15*a*, 15*b* and 15*c* of the indoor heat exchanger 6*a*, 6*b* and 6*c* are closed while the other change-over valves 16*a*, 16*b* and 16*c* are opened.

The valve opening degree of the auxiliary refrigerant pressure reducers 18*a* and 18*b* is set to a substantially full open value. The opening degree of each refrigerant pressure reducer 17*a*, 17*b*, 17*c* is adjusted in accordance with the cooling load of each indoor side unit 5*a*, 5*b*, 5*c*.

Through this operation, the high-pressure gas refrigerant discharged from the compressors 2*a*,2*b* flows through the discharge pipes 7*a*,7*b*, the high-pressure gas pipe 12, the change-over valves 9*a*,9*b* and the outdoor heat exchanger 3*a*,3*b* in this order to be condensed and liquefied. The liquefied high-pressure refrigerant flows through the auxiliary refrigerant pressure reducers 18*a*,18*b* which are substantially fully opened in the valve opening degree and the liquid pipe 14, and distributed to the refrigerant pressure reducers 17*a*,17*b*,17*c* of the respective indoor units 5*a*,5*b*, 5*c*. The distributed refrigerant is reduced in pressure, and changed to low-pressure refrigerant in the refrigerant pressure reducers. The low-pressure liquefied refrigerant is vaporized in the respective indoor heat exchanger 6*a*,6*b*,6*c*, and flows through the change-over valves 16*a*,16*b*,16*c*, the low-pressure gas pipe 13, the suction pipes 8*a*,8*b* and the gas-liquid separators 4*a*,4*b* in this order into the compressors 2*a*,2*b*.

With this arrangement, each of the indoor heat exchanger 6*a*,6*b*,6*c* serves as a evaporator, and thus all the rooms are simultaneously cooled.

Conversely, in the case where all the rooms are simultaneously heated, the change-over valves 9*a*,9*b* of the outdoor heat exchanger 3*a*,3*b* are closed and the other change-over valves 10*a*,10*b* thereof are opened. In addition, the change-over valves 15*a*,15*b*,15*c* of the indoor heat exchanger 6*a*,6*b*, 6*c* are opened and the other change-over valves 16*a*,16*b*,16*c* thereof are closed. The opening degrees of each of the auxiliary refrigerant pressure reducers 18*a*,18*b* is adjusted in accordance with the driving load of the outdoor side units 1*a*,1*b*, and the opening degree of each of the refrigerant pressure reducers 17*a*,17*b*,17*c* is set to a substantially full state value.

Through this operation, the high-pressure gas refrigerant discharged from the compressors 2*a*,2*b* flows through the discharge pipes 7*a*,7*b* and the high-pressure gas pipe 12 in this order, and distributed to the change-over valves 15*a*, 15*b*,15*c* and the indoor heat exchanger 6*a*,6*b*,6*c*, so that the refrigerant are condensed and liquefied. Thereafter, the high-pressure liquefied refrigerant is reduced in pressure by each of the refrigerant pressure reducers 17*a*,17*b*,17*c*, and joins together in the liquid pipe 14. Thereafter, the joined liquefied refrigerant is vaporized in the outdoor heat exchanger 3*a*,3*b*, and flows through change-over valves 10a,10b, the suction pipes 8a,8b and the gas-liquid separators 4a,4b in this order into the compressors 2a,2b.

With this arrangement, each of the indoor heat exchanger serves as a condenser, and thus all the rooms are simultaneously heated.

In the case where any two rooms are cooled and one room is heated at the same time, the one change-over valve 9a of the outdoor heat exchanger 3a is opened, and the other change-over valve 10a of outdoor heat exchanger 3a and the change-over valves 9b and 10b of the outdoor heat exchanger 3b are closed. In addition, the change-over valves 15a,15c of the indoor side units 5a,5c for the cooling operation are closed, and the other change-over valves 16a,16c thereof are opened. In addition, the change-over valve 15b of the indoor side unit 5b for the heating operation is opened, and the other change-over valve 16b is closed.

Through this operation, a part of the refrigerant discharged from the compressors 2a,2b flows through the discharge pipe 7a and the change-over valve 9a in this order into the outdoor heat exchanger 3a. The residual refrigerant flows through the high-pressure gas pipe 12 into the change-over valve 15b of the indoor side unit 5b for the heating operation and the indoor heat exchanger 6b, so that the refrigerant is condensed and liquefied by the indoor heat exchanger 6b and the outdoor heat exchanger 3a. The refrigerant which is condensed and liquefied in the heat exchanger 6b and 3a flows through the liquid pipe 14, and then reduced in pressure in the refrigerant pressure reducers 17a,17c of the indoor side units 5a and 5c. Thereafter, the refrigerant is vaporized in each of the indoor heat exchanger 6a and 6c, flows through each of he change-over valves 16a,16c and then joins together in the low-pressure gas pipe 13. Thereafter, the joined refrigerant flows through the suction pipes 8a,8b and the gas-liquid separators 4a,4b into the compressor 2.

Through this operation, the indoor heat exchanger 6b serves as a condenser, so that the one room is heated. On the other hand, the other indoor heat exchanger 6a,6c serve as a evaporator, so that the other two rooms are cooled.

For an operation of cooling one room while heating two rooms, this operation can be performed by actuating the auxiliary refrigerant pressure reducer 18a.

For example in the case where the cooling operation is performed by the indoor side unit 5b while the cooling operation is performed by the indoor side units 5a and 5c, the change-over valve 10a of the outdoor heat exchanger 3a is opened, and the change-over valves 9a, 9b and 9c are closed. In addition, the change-over valve 15b of the indoor side unit 5b for the cooling operation is closed, and the other change-over valve 16b thereof is opened. In addition, the change-over valves 15a, 15c of the indoor side units 5a,5c for the heating operation are opened, and the other change-over valves 16a,16c thereof are closed.

Through this operation, the refrigerant discharged from the compressors 2a,2b flows through the discharge pipes 7a,7b and the high-pressure gas pipe 12 in this order and distributed to the change-over valves 15a,15c. Each distributed refrigerant is condensed and liquefied in each of the indoor heat exchanger 6a,6c. The liquefied refrigerant is supercooled by the refrigerant pressure reducers 17a,17b, and the flows into the liquid pipe 14. A part of the liquefied refrigerant in the liquid pipe is reduced in pressure in the refrigerant pressure reducer 17b, and then vaporized in the indoor heat exchanger 6b. The residual liquefied refrigerant is reduced in pressure in the auxiliary refrigerant pressure reducer 18a, and then vaporized in the outdoor heat exchanger 3a, thereafter flowing through the suction pipes 8a,8b and the gas-liquid separators 4a,4b in this order into the compressor 2.

With this arrangement, each of the indoor heat exchanger 6a,6c serves as a condenser, so that the two rooms are heated. On the other hand, the other indoor heat exchanger 6b serves as a evaporator, so that the residual one room is cooled.

In a case where the outdoor heat exchanger 3a and 3b each serving as the evaporator are frosted, a defrosting operation is carried out.

In this case, the change-over valve 9a is opened, and the other change-over valve 10a is closed to guide a part of high-temperature discharged refrigerant from the discharge pipe 7 to the outdoor heat exchanger 3a and defrost the outdoor heat exchanger 3a. Thereafter, the change-over valve 9a is closed and the other change-over valve 10a is opened, so that the outdoor heat exchanger 3a serves as a evaporator again. In addition, the change-over valve 9b is opened and the other change-over valve 10b is closed to guide a part of the high-pressure discharged refrigerant from the discharge pipe 7 to the other outdoor heat exchanger 3b and defrost the outdoor heat exchanger 3b.

Through this operation, the heating operation for all the rooms can be continuously performed while alternately defrosting the outdoor heat exchanger 3a and 3b.

Next, the features of the embodiment as described will be described.

According to the embodiment as described above, when the heat exchanger of some outdoor side units of plural outdoor side units are required to be defrosted, the defrost operation can be performed without stopping the driving of the outdoor heat exchanger of the other outdoor side units.

In a case where any one of the outdoor side units is required to be stopped due to reduction of the indoor load in the cooling operation, it has been hitherto adopted in the prior art that the outdoor controller 100a wholly stops the operation of all the equipments (for example, a compressor, an outdoor heat exchanger, etc.) of the outdoor side unit 1a on a outdoor side unit basis when a stop signal is output from the general controller 200 to the outdoor side unit 1a. In this case, the outdoor heat exchanger 3a of the outdoor side unit 1a which is stopped in the cooling operation cannot be effectively used. In order to avoid this disadvantage, according to this embodiment, the outdoor controller 100a performs the following control for the outdoor side unit 1a when the stop signal is output from the indoor controllers 101a, 101b, 101c through the general controller 200 due to reduction of the cooling load or the like. That is, the driving of the compressor 2a is stopped, but the change-over 9a and the refrigerant pressure reducer 18a are opened to drive the outdoor fan 31a.

Through this operation, the total capacity (power) of the heat exchanger is increased by the amount corresponding to the power of the outdoorheat exchanger 3a, and thus the pressure of the high-pressure refrigerant can be reduced to a small value. Therefore, the system efficiency can be improved.

For example, it is assumed that the pressure of the high-pressure refrigerant is about 18 kg/cm$^2$ when the compressor 2b has 10 horsepowers and the outdoor heat exchanger 3b has 10 horsepowers, and further it is assumed that the outdoor heat exchanger 3a (10 horsepowers) is operated and the total power of the outdoor heat exchanger 3a,3b is set to 20 horsepowers, the pressure of the high-pressure refrigerant can be reduced to about 13 kg/cm$^2$.

Accordingly, the system efficiency can be improved by the amount corresponding to the reduced value.

In this case, the power of the outdoor heat exchanger 3*a* is adjusted by adjusting the speed of the outdoor fan 31*a* or adjusting the openings degree of the refrigerant pressure reducer 18*a*.

If the pressure of the high-pressure refrigerant is excessively reduced during the above control operation, a gas lack state may occur in the indoor side unit and/or in the refrigerant cycle because the refrigerant remains in the pipe path.

The opening degree of the refrigerant pressure reducer 17*a* is set to a slightly open value if the difference between a detection value of an inlet side temperature sensor (gas lack sensor) 80*a* of the heat exchanger 6*a* in the indoor side unit 5*a* and a detection value of an outlet side temperature sensor (gas lack sensor) 81*a* in the cooling operation exceeds a predetermined value. In this case, the "gas lack state" corresponds to a state where the opening degree as described above exceeds the predetermined value. When there is a probability that the gas lack state occurs, the above control operation is not performed.

When an outside temperature is extremely low in the cooling operation, the pressure of the high-pressure refrigerant hardly increases, and thus the gas lack state is liable to occur in the indoor side units. Accordingly to this embodiment, by individually controlling the outdoor heat exchanger to reduce the number of outdoor heat exchanger to be driven (lower the heat exchange power), the pressure of the high-pressure refrigerant is increased to push out the refrigerant trapped in the refrigerant circuit, so that the gas lack state can be repaired. If the gas lack state cannot be avoided even by the above operation, the driving of the outdoor side unit is stopped.

When the stop signal of the outdoor side unit 1*a* is output from the indoor controllers 101*a*,101*b*,101*c* through the general controller 200 in the heating operation, the outdoor controller 100*a* performs the following control operation. That is, it stops the driving of the compressor 1*a*, but controls the change-over valve 9*b* and the refrigerant pressure reducer 18*a* to be opened to drive the outdoor fan 31*a*.

Through this operation, the total power (capacity) of the heat exchanger is increased by the amount corresponding to the power of the outdoor heat exchanger 3*a*, so that the vaporizing temperature in the outdoor heat exchanger 3*a*,3*b* can be increased and the system efficiency can be improved.

Next, the cooling and heating operation in which the cooling operation is performed by one indoor side unit while the heating operation is performed by the other indoor side unit will be described.

Figure 2:
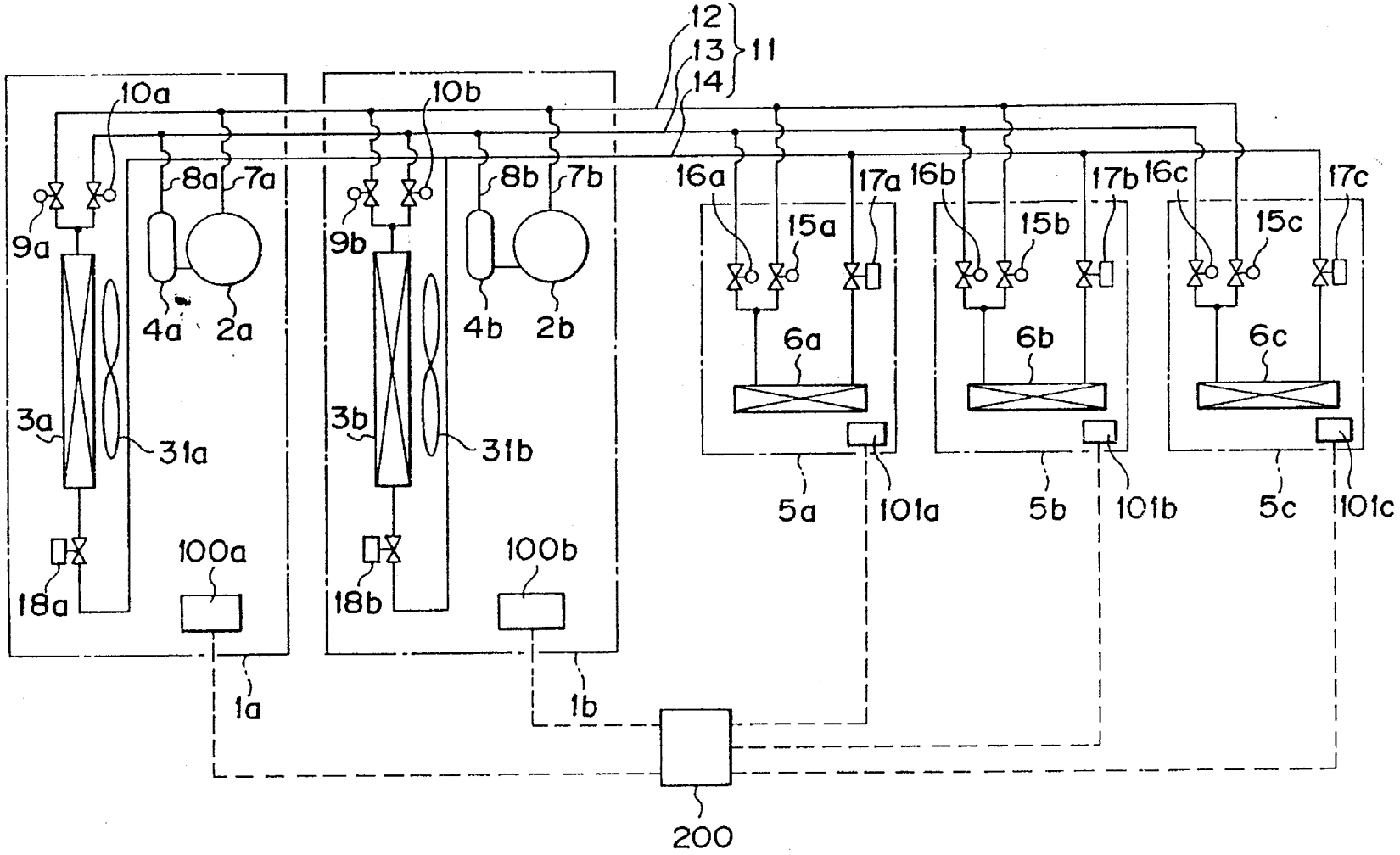
FIG. 2 is a refrigerant circuit diagram for the multiroom air conditioner in a cooling and heating operation.

Referring to FIG. 2, it is assumed that the indoor heat exchanger 6*a* (12 horsepowers) carries out the heating operation and the indoor heat exchanger 6*b* (5 horsepowers) and 6*c* (2 horsepowers) carry out the cooling operation. In this case, 12 horsepowers are required for the driving of the compressors 2*a*, 2*b*. For example, the compressor 2*a* is driven at 10 horsepowers, and the compressor 2*b* is driven at 2 horsepowers. However, with the arrangement as described above, the heat exchange operation of the outdoor side units as a whole may be sufficiently performed with the driving power corresponding to 5 horsepowers (=12−(5+2)) because of the off setting of the cooling and heating operations of the outdoor heat exchanger 3*a*,3*b*.

In this case, both of the compressors 2*a* and 2*b* are driven, but only one of the outdoor heat exchanger (only the outdoor heat exchanger 3*a*) is operated.

Specifically, the change-over valves 9*b*,10*b*,18*b* are fully closed so that no refrigerant flows into the other outdoor heat exchanger 3*b*, and the outdoor fan 31*b* is stopped. With this driving mode, the power (capacity) of the compressors can be beforehand set to a suitable value meeting a load while the power (capacity) of the outdoor heat exchanger is set to a small value in a case where the cooling and heating operation is required over a year.

In short, according to the embodiment as described above, various kinds of operations for improving the efficiency can be performed by providing the general controller for individually controlling the compressors of plural outdoor side units, the outdoor fans and the refrigerant path change-over valves.

Furthermore, according to the embodiment as described above, if a heat exchanger for water heating or a heat exchanger equipped with a boiler is connected to the system of these embodiments, the system efficiency can be heightened and the power demand can be reduced by switching to the heat exchanger for water heating at the peak time of power demand, or switching to the heat exchanger equipped with a boiler as an auxiliary equipment for winter.

This invention is not limited to the above embodiment, and various modifications may be made without departing from the subject matter of this invention.

For example, in the above embodiment, the compressor, the heat exchanger, etc. are provided every outdoor side unit (on an outdoor side unit basis. However, beyond the confines of the outdoor side unit basis, a compressor group for collectively controlling the driving of the compressors of the respective outdoor side units and a heat exchanger group for collectively controlling the driving of the heat exchanger of the respective outdoor side units may be set over the outdoor side units for the air conditioner. In order to perform such a group control, a signal for successively controlling the driving of the respective outdoor side units in accordance with the cooling or heating load of each room is output from the general controller and the outdoor controllers. In this case, the outdoor heat exchanger, each change-over valve, the outdoor fan and the pressure reducer of each outdoor side unit are successively controlled in accordance with the status of the refrigerant cycle.

As described above, according to the present invention, since the multiroom air conditioner is provided with the general controller for individually controlling the compressor, the outdoor fan and the refrigerant path change-over valve of each of plural outdoor side units, even when the driving of some outdoor unit is stopped due to reduction of the indoor load in the cooling or heating operation, the refrigerant is allowed to flow through the outdoor heat exchanger of the outdoor side unit to be stopped although the driving of the compressor of the outdoor side unit is stopped. Therefore, the outdoor heat exchanger of the outdoor side unit to be stopped can be effectively used, so that the system efficiency can be heightened.

Furthermore, when refrigerant lack occurs in an indoor side unit during the driving of the indoor side unit, the driving of the outdoor side unit to be stopped is perfectly stopped, so that no problem occurs due to the gas lack.

Still furthermore, the refrigerant is prevented from flowing through the outdoor heat exchanger of some outdoor side units in the cooling and heating mixing operation, so that the air conditioner can be driven at high efficiency.

What is claimed is:

1. A multiroom air conditioner in which each individual indoor side unit independently and selectively performs a room cooling operation or a room heating operation for an individual room, comprising plural outdoor side units each containing a compressor, an outdoor fan, an outdoor heat exchanger and a refrigerant path change-over valve;

plural indoor side units each containing an indoor heat exchanger;

an inter-unit pipe comprising a high-pressure gas pipe, a low-pressure gas pipe and a liquid pipe through which said plural outdoor side units are connected to said indoor side units to thereby form a refrigerant cycle; and a controller for individually controlling each of said compressor, said outdoor fan, said outdoor heat exchanger and said refrigerant path change-over valve.

2. The multiroom air conditioner as claimed in claim 1, wherein when said controller is supplied with a signal for stopping some outdoor side unit in accordance with an indoor load during a room cooling or heating operation, said controller switches said refrigerant path change-over valve of said outdoor unit and drives said outdoor fan thereof so that the driving of said compressor of said outdoor side unit is stopped, but refrigerant is allowed to flow into said outdoor heat exchanger of said outdoor side unit.

3. The multiroom air conditioner as claimed in claim 2, further comprising a gas-lack defection sensor for detecting lack of the refrigerant which is provided in the refrigerant cycle, wherein when the gas lack is detected by said gas-lack detection sensor, said controller reduces a heat exchange power of an outdoor side unit to which the stop signal is output, and if the gas-lack state is not repaired by reducing the heat exchange power, said controller stops the driving of said outdoor side unit completely.

4. The multiroom air conditioner as claimed in claim 1, wherein said controller outputs a signal for successively controlling the driving of said compressors of the respective outdoor side units in accordance with the indoor load, and said outdoor heat exchanger and said refrigerant path change-over valve of each outdoor side unit are controlled in accordance with a status of the refrigerant cycle.

5. The multiroom air conditioner as claimed in claim 1, wherein said controller continues the driving of said compressor of some outdoor side unit when the room cooling and heating operations are performed simultaneously with each other, and if a cooling load and a heating load are substantially equal to each other, said controller switches said refrigerant path change-over valve of said outdoor side unit and stops the driving of said outdoor fan thereof so that no refrigerant flows into said outdoor heat exchanger of said outdoor side unit.

6. A method of driving a multiroom air conditioner which comprises plural outdoor side units each containing a compressor, an outdoor fan, an outdoor heat exchanger and a refrigerant path change-over valve, plural indoor side units each containing an indoor heat exchanger, and an inter-unit pipe comprising a high-pressure gas pipe, a low-pressure gas pipe and a liquid pipe through which said plural outdoor side units are connected to the indoor side units to thereby form a refrigerant cycle, and in which each individual indoor side unit independently and selectively performs a room cooling operation or a room heating operation for an individual room, characterized in that when a stop signal is output to some outdoor side unit in accordance with an indoor load during a room cooling or heating operation, the refrigerant path change-over valve of the outdoor unit is switched and the outdoor fan thereof is driven so that the driving of the compressor of the outdoor side unit is stopped, but refrigerant is allowed to flow into the outdoor heat exchanger of the outdoor side unit.

7. The driving method for the air conditioner as claimed in claim 6, wherein a gas-lack defection sensor for detecting lack of refrigerant of the indoor side unit under operation is provided in the refrigerant cycle, and wherein in the outdoor side unit which is supplied with the stop signal on the basis of a signal from the gas-lack detection sensor, the driving of the compressor of the outdoor side unit is stopped, and the heat exchange power of the outdoor heat exchanger of the outdoor side unit is reduced, and if the gas-lack state is not repaired by reducing the heat exchange power, the driving of the outdoor side unit is completely stopped.

8. A method of driving a multiroom air conditioner which comprises plural outdoor side units each containing a compressor, an outdoor fan, an outdoor heat exchanger and a refrigerant path change-over valve, plural indoor side units each containing an indoor heat exchanger, and an inter-unit pipe comprising a high-pressure gas pipe, a low-pressure gas pipe and a liquid pipe through which the plural outdoor side units are connected to the indoor side units to thereby form a refrigerant cycle, and in which each individual indoor side unit independently and selectively performs a room cooling operation or a room heating operation for an individual room, characterized in that in a cooling and heating operation in which an indoor side unit performs a cooling operation while another outdoor side unit performs a heating operation, the compressor of some outdoor side unit is driven, and the refrigerant path change-over valve of the outdoor side unit is switched and the driving of the outdoor fan thereof is stopped so that no refrigerant flows into the outdoor heat exchanger of the outdoor side unit.

* * * * *